US010518268B2

(12) United States Patent
Hoefter et al.

(10) Patent No.: US 10,518,268 B2
(45) Date of Patent: Dec. 31, 2019

(54) PRESS ROLLER

(71) Applicants: Axel Hoefter, Meppen (DE); Kai-Uwe Habermann, Muelheim (DE)

(72) Inventors: Axel Hoefter, Meppen (DE); Kai-Uwe Habermann, Muelheim (DE)

(73) Assignee: MASCHINENFABRIK KOEPPERN GMBH & CO. KG, Hattingen (DE)

( * ) Notice: Subject to any disclaimer, the term of this patent is extended or adjusted under 35 U.S.C. 154(b) by 778 days.

(21) Appl. No.: 14/405,086

(22) PCT Filed: Jun. 28, 2013

(86) PCT No.: PCT/EP2013/063719
§ 371 (c)(1),
(2) Date: Dec. 2, 2014

(87) PCT Pub. No.: WO2014/012770
PCT Pub. Date: Jan. 23, 2014

(65) Prior Publication Data

US 2015/0136884 A1 May 21, 2015

(30) Foreign Application Priority Data

Jul. 18, 2012 (DE) ..... 10 2012 106 527

(51) Int. Cl.
*B02C 4/00* (2006.01)
*B02C 4/44* (2006.01)
(Continued)

(52) U.S. Cl.
CPC ..... *B02C 4/44* (2013.01); *B02C 4/30* (2013.01); *B02C 4/305* (2013.01); *B30B 3/005* (2013.01); *B30B 11/165* (2013.01); *B30B 15/34* (2013.01)

(58) Field of Classification Search
CPC ..... B30B 15/67; B30B 3/005; B30B 11/165; B02C 4/305; B02C 4/44; B02C 4/30; B02C 15/34; B02C 15/004
(Continued)

(56) References Cited

U.S. PATENT DOCUMENTS 3,807,486 A 4/1974 Paton et al.
3,873,259 A 3/1975 Kennedy
(Continued)

FOREIGN PATENT DOCUMENTS

DE 809546 A 7/1951
DE 1029723 A 5/1958
(Continued)

*Primary Examiner* — Faye Francis
(74) *Attorney, Agent, or Firm* — Andrew Wilford

(57) ABSTRACT

A roller for a roller press has a core formed with axially opposite outer ends, an axially central passage, and axially spaced and radially extending inlet and outlet passages extending radially at the outer ends from the central passage and opening radially outward at an outer surface of the core. A coolable jacket surrounds the core, and respective manifold rings are mounted on outer ends of the core, cover inlet and outlet passages at the end faces of the jacket. Respective L-shaped connecting passages each have an axially extending segment opening into a respective one of the cooling passages of the jacket and a radially extending segment opening into the respective groove.

10 Claims, 5 Drawing Sheets

(51) Int. Cl.

| | |
|---|---|
| ***B02C 4/30*** | (2006.01) |
| ***B30B 3/00*** | (2006.01) |
| ***B30B 11/16*** | (2006.01) |
| ***B30B 15/34*** | (2006.01) |

(58) Field of Classification Search
USPC ..... 241/65, 66, 67; 492/46
See application file for complete search history.

(56) References Cited

U.S. PATENT DOCUMENTS 3,907,486 A * 9/1975 Kennedy ..... B30B 11/165 425/237
4,019,846 A * 4/1977 Greenberger ..... B21B 27/08 425/194
4,123,971 A * 11/1978 Bergendahl ..... B30B 11/165 100/336
4,944,342 A * 7/1990 Lauener ..... B22D 11/0682 164/423
5,152,333 A * 10/1992 Barbe ..... B22D 11/0651 164/423
6,039,556 A 3/2000 Jens et al.
6,086,003 A * 7/2000 Gunter ..... B02C 4/305 241/235
6,436,022 B1 * 8/2002 Zaoralek ..... D21G 1/0266 492/46
2003/0181303 A1 * 9/2003 Leinonen ..... D21F 5/022 492/46
2008/0191074 A1 * 8/2008 Hagedorn ..... B02C 4/305 241/235

FOREIGN PATENT DOCUMENTS

| | | | |
|---|---|---|---|
| DE | 2536668 | A | 3/1977 |
| DE | 19833456 | A | 1/2000 |
| GB | 1504624 | B | 3/1978 |
| GB | 1523180 | B | 8/1978 |

* cited by examiner 4
2
10
18
10
3
16,17

PRESS ROLLER

CROSS REFERENCE TO RELATED APPLICATIONS

This application is the US-national stage of PCT application PCT/EP2013/063719 filed 28 Jun. 2013 and claiming the priority of German patent application 102012106527.6 itself filed 18 Jul. 2012.

FIELD OF THE INVENTION

The invention relates to a roller for a press, in particular for briquetting, compacting, or grinding granular material, having a core and a cooled or coolable jacket attached to the core.

SUMMARY OF THE INVENTION

As a rule a roller press has two rollers that rotate oppositely. In briquetting and compacting, granular bulk material is compacted between the rollers. To this end as a rule, the jacket is provided on its outer surface with press formations, for example mold cavities for briquetting or compacting. However, the invention also includes rollers with jackets that are provided with a different wear protection surface, for example for (high pressure) comminution of material.

In particular during hot briquetting or hot compacting the rollers are exposed to high temperatures by the material being processed so that the jackets themselves also become very hot. This is true for example when processing reduced iron ore or iron sponge, whose temperature may be greater than 900° C. At high temperatures, as a rule the jackets and in particular the rollers thereon (for example mold cavities) are subject to high wear. In order to limit the wear, it has already been proposed to cool the rollers or their jackets, for example by water.

Thus, DE 1 029 723 describes a press roller for a briquette press that comprises a hollow roller body and a shaped jacket, where the cylindrical roller shell is provided on its outer surface with a generally helical groove in the region of the shrink-fitted molded jacket, which groove together with the molded jacket forms a coolant or heating agent passage. The cooling passages are consequently so to speak between the core and the jacket.

The situation is similar for a press roller described in German patent DE 809 546 that has a roller shell shrink-fitted on a core and in which the passages that open at each end into an annular space with radially inwardly extending bores are formed as grooves on the surface of the axis barrel.

A press roller with cooling is also known from DE 25 36 670 [GM 1,523,180]. Here, the core is cooled via a plurality of cooling passages extending parallel to the rotation axis and formed in the core itself. The shell of the roller comprises a plurality of segments that are adjacent one another on the outer surface with axially extending longitudinal edges and that are detachably connected at their ends to the core.

To reduce the cooling of the press formations and thus the wear on the press formations it has already been proposed to integrate into the shell itself axially extending cooling bores that are connected to passages for input and output of a cooling medium in the core (see DE 25 36 668). In this embodiment as well, the shell is formed by a plurality of segments detachably attached to the core. The axially extending cooling passages formed in the segments are connected to the radial bores formed in the core via suitable connecting means, for example elbows. Alternatively, the cooling passages, all or in groups, are connected to one or a plurality of annular lines that are then connected to a radial input or output port. In practice this must also be realized using separate pipes, corrugated steel tubes, or the like, a shell made of a plurality of segments especially being used.

A press roller of the type described above is known for example from DE 198 33 456. Deflection or manifold rings are attached laterally to the jacket and are positioned directly on the ends of the jacket. The deflection or manifold rings have on their inner surface associated with the jacket end circumferential annular grooves that distribute the coolant over the entire end face region of the jacket that is covered by the deflection ring. The deflection or manifold rings are each connected via separate pipe connections to the radial inlet and outlet passages.

OBJECT OF THE INVENTION

Proceeding from the known prior art, the underlying technical object of the invention is to create a roller for a roller press of the type described above, which roller is distinguished by improved cooling.

SUMMARY OF THE INVENTION

For attaining this object, the invention has a roller for a roller press, having a core and a cooled or coolable jacket attached to the core, wherein a plurality of cooling passages that extend axially and that are spaced angularly are formed in the jacket inward of the (outer) jacket surface (that is, the work surface) and are connected to an axial central passage in the core via radially extending inlet and outlet passages, wherein at least two manifold rings that are each mounted on a respective end face of the jacket are provided on the core, in which manifold rings are formed annular passages that extend angularly and that are (each directly) connected on the one hand to the radial inlet and outlet passages and on the other hand to the axially extending cooling passages.

Such a roller is intended in particular for briquetting or compacting and especially preferably is intended for hot briquetting or hot compacting. However, the invention also includes rollers for other purposes, for example for comminuting or grinding granular material.

The invention first proceeds from the understanding that effective cooling is attained with cooling passages formed in the jacket. The cooling passages are consequently very close to the jacket surface or close to the press formations and/or wear protection surfaces on the jacket so that cooling occurs where locations heat is applied. Such effective cooling leads in particular to longer service lives and lower maintenance costs, because wear on the jacket and the press formations provided thereon is significantly reduced. In addition, due to the cooling of the jacket, there is the opportunity to attach the (tubular) jacket, which is preferably formed in one piece and is entirely circumferential, to the core with no problem, and specifically in particular using heat shrinking. There is no longer the risk that the shrink-fitted jacket will detach from the core due to heating. Finally, the cooling improves the performance of the roller press because overall it is possible to work with higher through-puts without an increase in the formation temperature. Furthermore, the cooling and the thus tension-optimized embodiment prevents damage, for example due to the formation of cracks. These advantages are inventively attained, in particular also in a simple manner in terms of production engineering, in that at least two manifold rings are each attached to an end face of the jacket and are formed with annular passages that extend angularly and that on the one hand are connected to the radial inlet and outlet passages and on the other hand to the axially extending cooling passages. The manifold rings ensure proper distribution of the cooling medium, for example the coolant fluid, preferably water or the like, to the annular passages integrated therein. During the course of production it is possible to do without the use of complex piping, corrugated steel tubes, or other connections. This is because the coolant is properly distributed via the separately produced manifold rings in which the annular passages are formed. The coolant travels out of the central passage via the radially extending inlet and outlet passages into the manifold ring and there is distributed via the annular passage to the individual axially extending cooling passages.

In accordance with the invention, the radial inlet and outlet passages on the one hand and the axially extending cooling passages on the other hand are connected via the manifold rings, and specifically without separate piping, corrugated steel tubes, and the like. This works for example in that the manifold rings are connected via seals directly to the jacket and to the core. To this end the manifold rings are each mounted in the region of the radial inlet and outlet passages on the core such that they cover the radial inlet and outlet passages. In an axial section through the roller, the manifold rings, which are attached to the jacket at both ends, consequently extend through the roller to radially outward of the radial inlet and outlet passages so that the manifold rings may be attached directly to the core and to the radial inlet and outlet passages, with the addition of seals, and without the use of piping, corrugated steel tubes, or the like. The seals between the manifold ring and the core are especially preferably annular, for example O-rings. The seals between manifold ring and jacket are especially preferably flat seals.

The invention is distinguished by a particularly simple structure and optimized cooling. Being able to do without separate connecting pipes or the like makes it possible to use the entire roller width so that it is possible to work with wider jackets or jacket segments. This also optimizes cooling so that, surprisingly, despite the high temperatures the manifold rings may be connected directly to the core, with the addition of suitable seals, without for example corrugated tubes being necessary.

The manifold rings are particularly preferably each formed as completely circular, one-piece manifold rings, for example made of steel. The required passages may be formed in the manifold rings by machining. Moreover, these separate manifold rings have the advantage that they may also be reused independently of the jacket, for example if the jacket has to be replaced after wear. Thus there is for example the opportunity merely to attach the manifold rings to the jacket (and not to the core), for example detachably by screws.

In terms of production engineering, the manifold ring is particularly simple to make when grooves are formed in the inner surface of the manifold rings and extend angularly on the inner surface over at least some of the inner surface and that, with the core, form the annular passages when the manifold ring is assembled. Consequently it is not necessary to "completely" integrate the annular passages in the manifold rings, but instead the open grooves may merely be formed in a simple manner, from a production engineering perspective, on the inner surface so that the annular passages are then ultimately created during assembly, the annular passages then being delimited on one side by the outer surface of the core.

It is useful to connect the manifold rings to the jacket and/or to the core via seals. Preferably seals are provided both between the jacket and the manifold ring and between the manifold ring and the core. A seal between the manifold ring and the core is particularly useful when the annular passages are formed by the above-described grooves. Seals between the manifold ring and jacket are advantageous because the annular passage is connected to the individual cooling passages via respective connecting passages that may be formed for example as deflection passages. It is possible to use for example graphite seals or graphite laminate seals for the seals.

It is in the scope of the invention that only one single annular passage that extends completely around the entire outer surface is formed in each manifold ring. This has the advantage that then for each manifold ring also only one radial inlet or outlet bore is necessary so that there is minimal influence on the stability of the core. According to one preferred embodiment, however, it is also possible to add to each manifold ring a plurality of annular passages, none of which extends around the entire outer surface, but instead that extend over a certain circumferential angle of for example 90° to 180° and each of which may be connected to the central passage via a respective separate inlet or outlet passage. Thus, it is possible to work for example with two annular passages per manifold ring, each annular passage extending over an angle of 180°. Such an embodiment has the advantage that the distribution of the cooling medium may be optimized, in particular with respect to the most uniform possible distribution and thus uniform cooling. In such an embodiment having for example two annular passages, only two supply passages and two discharge passages are then required so that it is likewise possible to work with relatively few bores in the core. In principle the uniform cooling distribution could be optimized using further division into a plurality of annular passages. However, due to the number of radial bores that would then be necessary, this could adversely affect the stability of the roller so that it is preferably used with no more than four annular passages or passage segments per manifold ring.

To improve the distribution of the cooling medium and to realize the most uniform possible cooling, according to another proposal of the invention it is useful to integrate into the cooling passages or into some cooling passages flow restrictors that reduce the flow cross-section of individual cooling passages by a predetermined amount. The invention here proceeds from the understanding that it makes sense from a production engineering perspective to first form all of the cooling passages with the same cross-section. Depending on the geometry of the annular passage, and in particular on the position of the supply passages, however, cooling may not be uniform because proceeding from the radial supply passage not all cooling passages are provided coolant in a uniform manner. In a preferred refinement of the invention, this fact may be taken into account in that a few cooling passages are provided with suitable flow restrictors. These are preferably simple reductions in diameter that may be realized for example by using suitable annular elements or shutters that are formed in or provided in the cooling passages. These elements or shutters are preferably not integrated directly into the cooling passages that are mounted directly in the jacket, but instead are formed in the segments adjacent thereto in the manifold rings. It may be determined in advance using appropriate calculations and especially preferably using appropriate trials which cooling lines should be provided with respective flow restrictors or which flow restrictors should be provided for corresponding cooling, it being entirely possible for different flow restrictors to be used in different cooling lines. Thus it may be useful to reduce diameters by more than 20%, possibly even by more than 40%, in individual cooling lines. In any case, using appropriate flow restrictors it is possible to realize overall proper, uniform cooling, and specifically even when working with only one or two annular passages per manifold ring.

The manifold ring is preferably made of steel. As a rule this is also true of the core. The jacket may also be made of steel, the press formations formed on the jacket and the wear surface preferably being produced using powder metallurgy and being attached to the jacket, for example using hot isostatic pressing (HIP). It is particularly preferred that the inventive cooling passages consequently are used with a jacket whose press formations and/or wear protection surface is produced using powder metallurgy, for example using hot isostatic pressing.

The invention is preferably realized in a one-piece, completely tubular annular jacket. This is preferably shrink-fitted onto the core. However, the invention also includes other types of attachment, for example gluing or by keys.

BRIEF DESCRIPTION OF THE DRAWING

The invention shall be explained in greater detail in the following using drawings that illustrate just one illustrated embodiment.

SPECIFIC DESCRIPTION OF THE INVENTION

Figure 1:
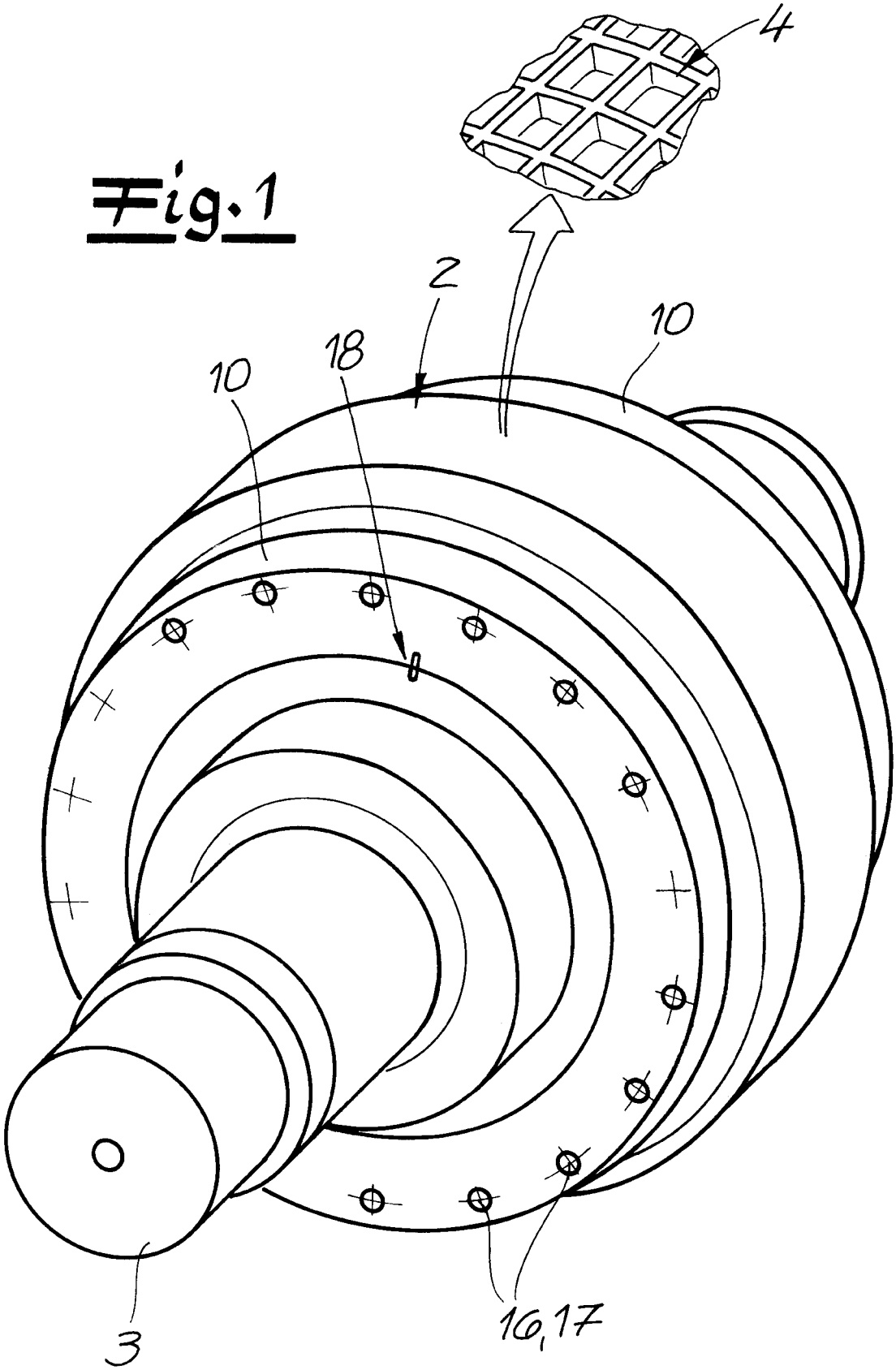
FIG. 1 is a perspective elevation of an inventive roller.

FIG. 1 shows a roller for a roller press, in particular for briquetting or compacting and particularly preferably for hot briquetting or hot compacting granular material. Such a roller comprises in its basic structure a core 1 and a jacket 2 attached to the core 1. The core 1 is integral with a shaft 3 that is rotatable in bearings 5 in an unillustrated machine frame. The jacket 2 is formed as a tubular one-piece annular jacket that may be attached to the core 1 for example by heat-shrinking. On its outer surface, the jacket 2 is provided with press formations 4 that may be formed for example as mold cavities for briquetting or compacting. This press formations 4 are shown in large scale in FIG. 1. The jacket 2 is made for example from steel, and the press formations 4 are formed as wear surfaces, for example using powder metallurgy, and are applied to the jacket 2, for example using hot isostatic pressing. In this manner a jacket 2 produced in one piece is produced with integrated formations or mold cavities.

In accordance with the invention, the roller is liquid-cooled, for example water-cooled. To this end, formed in the jacket 2 inward of the jacket outer surface or of the formations 4 is a plurality of cooling passages 6 that extend axially and that are spaced angularly. It may be seen that these axially extending cooling passages 6 are not formed in the core 1, but instead are formed in the jacket 2 so that cooling of the roller surface or the formations 4 is particularly effective. These axially extending cooling passages 6 are connected to an axially extending central passage 8 in the core 1 via radially extending inlet and outlet passages 7. This central passage 8 is connected via a suitable rotary feedthrough to a fluid inlet and outlet device 9 that is positioned laterally on the roller shaft 3.

In accordance with the invention, the cooling medium is distributed via two manifold rings 10 that are connected to the jacket 2, one on each end face. These are separate, completely annular, one-piece manifold rings 10 that may be for example made of steel and that are attached to the ends of the jacket 2. Formed in these manifold rings 10 are one or a plurality of annular passages 11 that extend angularly around the respective manifold rings 10 and that are connected either to the respective radial inlet or outlet passage 7 and on the other hand to the ends of the axially extending cooling passages 6. Consequently the coolant is distributed in a simple manner via these separate manifold rings 10. One of the rings 10 forms a manifold ring via which the fluid is fed in and the other opposing ring similarly forms an output ring. The term "manifold ring" thus encompasses its input function, as well.

The figures show that the radial inlet and outlet passages 7 on the one hand and the axially extending cooling passages 6 on the other hand are connected to one another solely via the manifold rings 10, without using separate piping or corrugated steel tubes. To this end, the manifold ring 10 is sealed, both axially against the jacket 2 and radially against the core 1 by seals 14 and 15. The manifold rings 10 are each mounted at the radial inlet and outlet passages 7 on the core 1 such that the manifold rings 10 so to speak cover the inlet and outlet passages 7. In this manner nearly the entire roller width may be used for the jacket 2.

The seals 14 and 15 are rings. Two perforated flat seals 14 are provided between each manifold ring 10 and jacket 2, specifically preferably one flat perforated seal 14 per manifold ring 10. Provided between each manifold ring 10 and the core 1 are two respective annular seals that preferably have the same diameter and that flank the respective radial inlet and outlet passage 7. These seals 15 may be for example O-rings.

Figure 3:
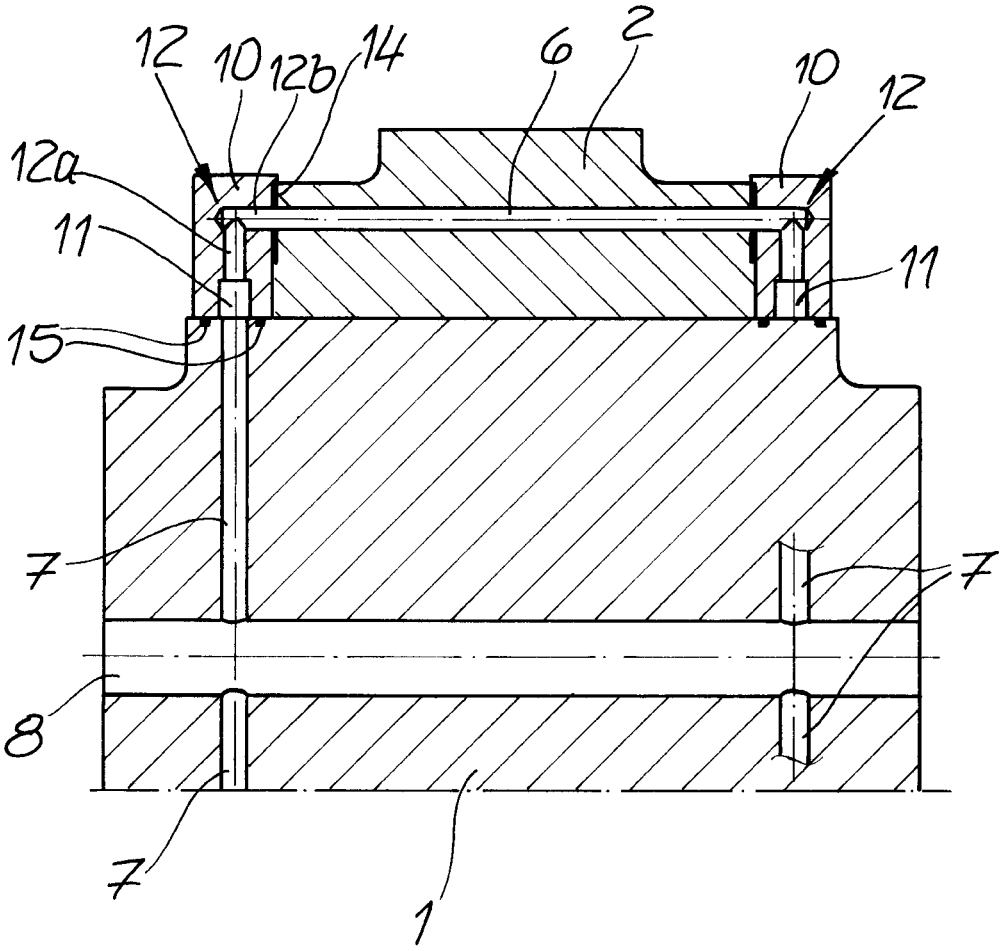
FIG. 3 is a simplified axial section (in a different section plane)
Figure 4:
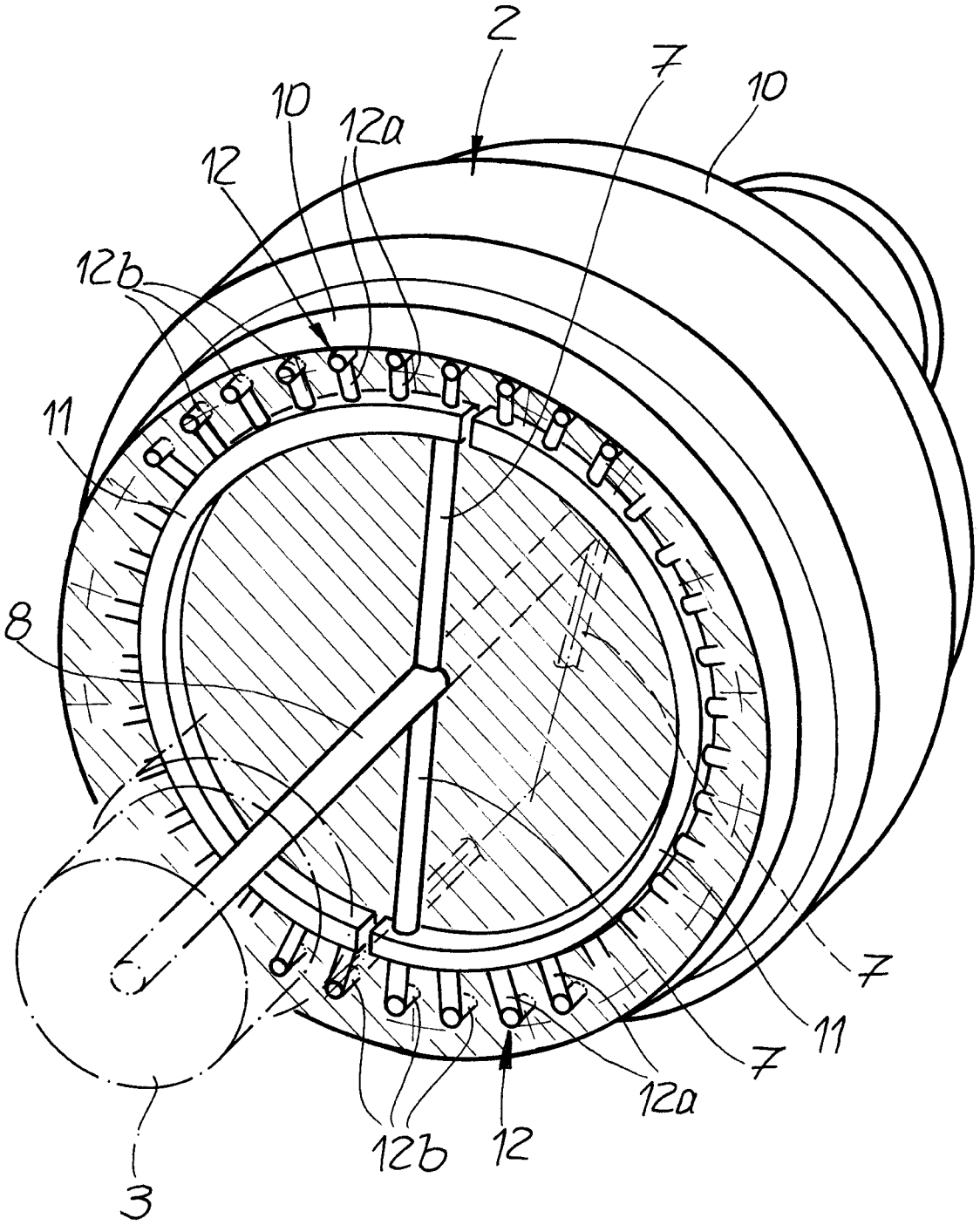
FIG. 4 is a "partly sectional" view of the roller of FIG. 1.

It may be seen in particular in FIGS. 3 and 4 that the annular passages 11 formed in the manifold rings 10 are connected to the individual cooling passages 6 via a plurality of connecting passages 12 that are formed in the illustrated embodiment as deflection passages 12 that each have one radially extending passage segment 12*a* and one axially extending passage segment 12*b*, the radial passage segments 12*a* being connected to the respective annular passages 11 in a star shape and the axial passage segments 12*b* opening into the cooling passages 6 that extend from them parallel to the axis.

Figure 2:
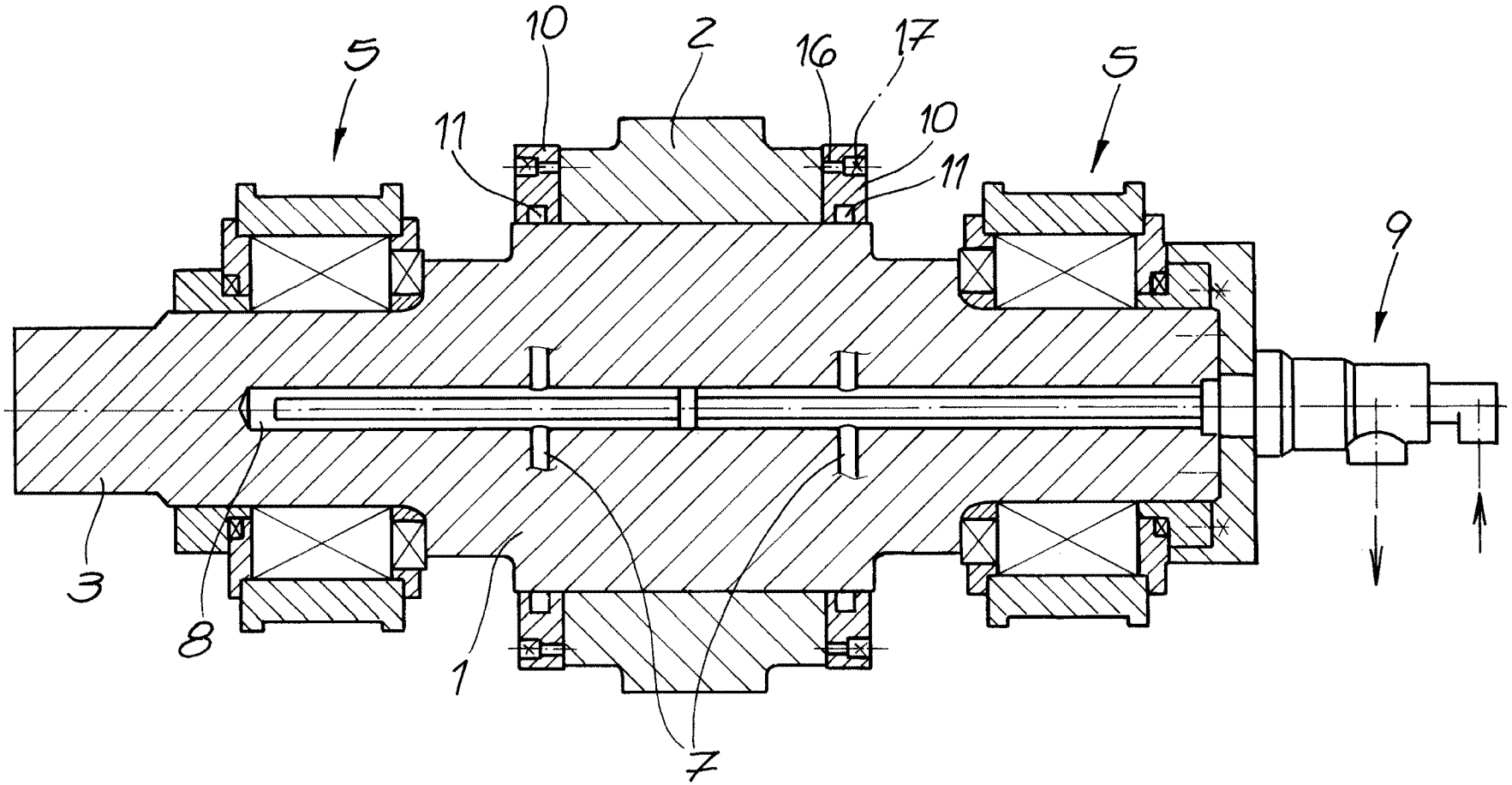
FIG. 2 is an axial section through the roller of FIG. 1.
Figure 5:
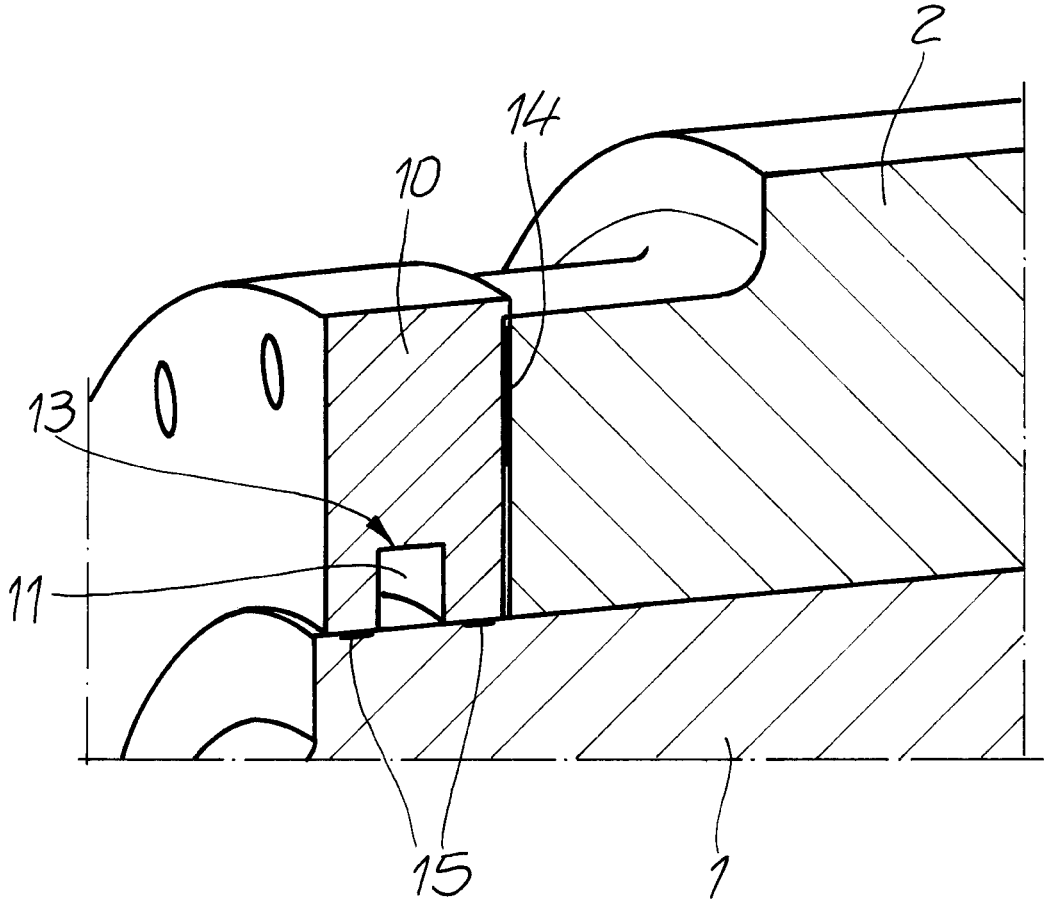
FIG. 5 is a partly sectional and large-scale perspective view through part of the roller of FIG. 1, in a different view.

In the illustrated embodiment, for realizing the annular passages 11, the inner surface of each of the manifold rings 10 is formed with a groove 13 that extend angularly around at least part of the inner surface and that, when the manifold ring 10 is assembled, with the core 1 form the respective annular passages 11. This may be seen for example from FIG. 2 and in particular from FIG. 5. Thus FIG. 5 shows the groove 13 formed in the inner surface of the manifold ring 10, for example by machining. This groove 13, together with the outer surface of the core 1, forms the annular passage 11. FIGS. 3 and 5 show that in these embodiments, the seals 14 and 15 are, respectively, between the manifold rings 10 and the jacket 2 and between the manifold rings 10 and the core 1. FIG. 2 also shows that the manifold rings 10 are secured detachably to the jacket 2, specifically by screws 17. To this end, suitable through going holes, for example bores 16, have been formed in the manifold rings 10, through which the respective screws 17 may be inserted into the jacket.

Now it is possible to forego separately attaching the manifold rings 10 to the core 1. It is particularly advantageous that the manifold rings 10 may be used for different purposes regardless of the jacket 2, for example after the jacket 2 is worn.

FIG. 4 also illustrates that not just one single completely annular passage 11 is formed in each manifold ring 10, but instead that two annular passages 11 are formed in the manifold ring 10 and each extends (only) through an angle of 180°. Each of these semicircular passages 11 is connected to the central passage 8 via a (single) respective intake/output passage 7. Using two separate semicircular passages and consequently two separate cooling system improves the distribution of coolant. Nevertheless, it is not necessary to add a plurality of radially extending passages to the core so the embodiment can be counted on to be stable.

In principle, there is the need to attain uniformly distributed cooling over the outer surface. This requires that the coolant act uniformly on the individual cooling passages 6 or that the coolant flow uniformly therethrough. If, as shown in the figures, annular passages 11 are used that extend through a large angle, the flow output into the individual cooling passages may not be uniform. Thus there is the possibility that more coolant may flow through some cooling passages 6 than through other cooling passages. In view of this, it may be advantageous, while the roller is being produced or while the jacket and/or manifold rings are being produced, to integrate flow restrictors into individual cooling passages 6 or to allocate flow restrictors to these cooling passages. Simple mechanical reductions in diameter may be used. In terms of production engineering, this may be realized in a simple manner for example in that inserted in or worked into the axial segments 12*b* of the connecting passages 12 are restrictions that have a smaller diameter than the cooling passages 6. This may be determined in advance for example using trials so that manifold rings are manufactured that are distinguished by improved distribution of the coolant. These restrictions, which may be formed for example as shutters, are not shown in the drawings.

To facilitate assembly, it may be useful to provide assembly indicia 18 on the core and on the manifold rings, for example grooves or other markings that are aligned with one another by rotation.

The invention claimed is:

1. A roller for a roller press for briquetting, compacting, or grinding granular material, the roller comprising:

a core extending along an axis and formed with axially opposite outer ends, an axially central passage, and axially spaced and radially extending inlet and outlet passages extending radially at the outer ends from the central passage and opening radially outward at an outer surface of the core;

a coolable jacket attached to and surrounding the core and formed with two axially oppositely directed end faces past which the axial opposite outer ends of the core extend axially, and a plurality of axially extending cooling passages that extend axially between the end faces, that open axially outward at the end faces, and that extend in the jacket radially inward of an outer surface of the jacket and radially outward of an inner surface of the jacket; and respective manifold rings mounted on the outer ends of the core, covering the inlet and outlet passages at the end faces of the jacket, and each formed with an annular and radially inwardly open groove that extends angularly and into which a respective one of the inlet and outlet passages opens and respective L-shaped connecting passages each having an axially extending segment opening into a respective one of the cooling passages of the jacket and a radially extending segment opening into the respective groove, such that coolant can flow from the inlet passage to the groove of one of the manifold rings, then radially and axially through the passages of the one manifold ring to the cooling passages at the respective end face of the jacket, then axially through the cooling passage to the other end face of the jacket, then axially and radially to the groove of the other manifold ring, and thence out the outlet passage without separate piping or corrugated steel tubes.

2. The roller defined in claim 1, wherein the jacket is completely tubular and of one piece.

3. The roller defined in claim 2, wherein the jacket is attached to the core by shrink-fitting.

4. The roller defined in claim 1, wherein the outer surface of the jacket is formed with press formations and/or is provided with a wear protection surface.

5. The roller defined in claim 4, wherein the press formations and/or the wear protection surface is/are produced using powder metallurgy and is/are attached to the jacket by hot isostatic pressing.

6. The roller defined in claim 1, wherein the manifold rings are each completely annular and of one piece.

7. The roller defined in claim 1, further comprising:

a pair of seal rings between each of the manifold rings and the jacket and flanking the axially extending segments of the L-shaped passages and another pair of seal rings between each of the manifold rings and the core and flanking the radially inwardly open groove of the manifold ring.

8. The roller defined in claim 1, wherein each manifold ring is formed with a plurality of the grooves that extend through an angle of 90° to 180° and that each communicate with the central passage via a respective inlet or outlet passage.

9. The roller defined in claim 1, further comprising:

screws securing the manifold rings detachably to the jacket.

10. The roller defined in claim 1, further comprising:

restrictions in at least some of the cooling passages that reduce the flow cross-section thereof by a predetermined amount.

* * * * *